US009004741B2

(12) United States Patent
Stephenson

(10) Patent No.: US 9,004,741 B2
(45) Date of Patent: Apr. 14, 2015

(54) DEVICE FOR AGITATING A CANISTER OF MATERIAL

(71) Applicant: Daniel E. Stephenson, Hilton Head, SC (US)

(72) Inventor: Daniel E. Stephenson, Hilton Head, SC (US)

( * ) Notice: Subject to any disclaimer, the term of this patent is extended or adjusted under 35 U.S.C. 154(b) by 0 days.

(21) Appl. No.: 13/897,920

(22) Filed: May 20, 2013

(65) Prior Publication Data

US 2014/0340981 A1 Nov. 20, 2014

(51) Int. Cl.
*B01F 11/00* (2006.01)
*B01F 9/00* (2006.01)

(52) U.S. Cl.
CPC ..... *B01F 9/0016* (2013.01); *B01F 9/003* (2013.01); *B01F 11/0025* (2013.01)

(58) Field of Classification Search
CPC .... B01F 9/0025; B01F 11/0017; A61C 5/068
USPC ..... 366/110, 128, 130, 216, 209, 228, 233
See application file for complete search history.

(56) References Cited

U.S. PATENT DOCUMENTS

| | | | | |
|---|---|---|---|---|
| 2,228,765 | A * | 1/1941 | Jerwan | 366/211 |
| 2,846,201 | A | 8/1958 | Morris | |
| 3,330,537 | A | 7/1967 | Wason | |
| 3,735,964 | A * | 5/1973 | Lorenzen | 366/211 |
| 4,318,622 | A | 3/1982 | Sterrenberg | |
| 4,420,262 | A | 12/1983 | Sterrenberg | |
| 5,098,193 | A | 3/1992 | Christensen | |
| 5,451,105 | A | 9/1995 | Koering | |
| 5,897,205 | A | 4/1999 | Sinsteden | |
| D567,578 | S | 4/2008 | Chiappetta | |
| 7,997,787 | B2 | 8/2011 | Blair | |
| 8,132,960 | B2 * | 3/2012 | Zhuang | 366/216 |
| 2003/0012082 | A1 | 1/2003 | Carter | |

* cited by examiner

*Primary Examiner* — Tony G Soohoo
*Assistant Examiner* — Anshu Bhatia
(74) *Attorney, Agent, or Firm* — Woodard, Emhardt, Moriarty, McNett & Henry LLP

(57) ABSTRACT

A device for agitating a canister of material to mix the material therein. A housing in which the canister is inserted has a ball mounted to the bottom end of the housing. The ball is mounted on an axle driven by an external rotary power drill. The ball is located offset with respect to a main axis of the housing and is also mounted offset with respect to the axle of rotation thereby causing rotation of the canister as well as reciprocal motion of the canister.

10 Claims, 5 Drawing Sheets

DEVICE FOR AGITATING A CANISTER OF MATERIAL

BACKGROUND OF THE INVENTION

1. Field of the Invention

The present invention relates to the field of agitating devices for shaking containers of material and in particular aerosol canisters.

2. Description of the Prior Art

A variety of materials are stored in various types of containers. In many cases, the containers must be violently moved or agitated in order to evenly mix the material therein. For example, fairly large paint container shakers may be found in hardware stores that violently shake the container both in a vertical and horizontal direction. Some containers are relatively small thereby not requiring such a large apparatus to achieve uniform mixing within the container. A number of U.S. patents have been granted on such devices.

In the U.S. Pat. No. 2,846,201, a paint mixing machine is disclosed that mixes paint by shaking the can of paint violently and rapidly. An electric motor is mounted to the mixing device for causing movement of the container holder.

In lieu of permanently mounting the driving motor to the container holder, devices have been provided wherein a portable tool, such as a sander or rotary drill, is removably attached to the container holder. For example, U.S. Pat. No. 7,997,787 discloses a cradle for holding a can of paint or an aerosol spray paint container with the cradle then being connected to a handheld reciprocating power tool. Operation of the reciprocating power tool results in reciprocating movement of the paint container. It can be appreciated that the holder of the reciprocating power tool receives the reciprocating force and must tightly hold onto the power tool as it conveys the reciprocating motion.

Another type of device for importing reciprocating motion to a container of material is disclosed in U.S. Pat. No. 3,330,537 wherein the container of material is mounted to and beneath the sanding plate of a portable sander. Operation of the handheld sander then imparts reciprocating motion not only to the container of material but also to the user.

Utilization of a handheld rotary power tool avoids the issue of reciprocating motion applied to the user since the chuck of the rotary tool imparts rotary motion to the cradle holding the container of material. U.S. Pat. No. 5,098,193 discloses a rotary drill removably engageable with a cradle for holding a spray can. U.S. Pat. Nos. 4,420,262 and 4,318,622 disclose an apparatus for utilizing a handheld power drill for shaking paint containers and the like. Another approach is to mount an aerosol can atop a vibrator which then shakes the aerosol can. Typically, vibrators are not readily available in the handyman's tool chest.

A further approach is disclosed in U.S. Pat. No. 5,897,205 wherein a flexible membrane is attachable to a tool having a reciprocal motion output, such as a jigsaw. The flexible membrane forms a suction bond with the concave bottom surface of an aerosol can and reciprocates the can.

A portable device powered by rotary hand drill is disclosed in U.S. Pat. No. 5,451,105 wherein the output of the rotary drill is removably attached to a cam mounted in a housing containing the container of material to be mixed. Repeated engagement of the cam with the bottom of the aerosol container results in reciprocal motion of the container within the holder.

Despite all of the various techniques and devices known to mix materials within a container or canister, there is still a need for a lightweight device powered by a tool that is commonly readily available. Such a power tool is a rotary drill which typically is lightweight and can be held in one hand while the container of material is movably mounted within a housing. The motion imparted must be limited in that the violent motion should not be imparted to the holder of the power drill but yet sufficient so as to move the container in such a manner to thoroughly mix the material therein. Disclosed herein is such a device which imparts not only reciprocal motion to the container of material but also rotary motion along the longitudinal axis of the container.

SUMMARY OF THE INVENTION

One embodiment of the present invention is a device for agitating a canister of material having a longitudinally extending center axis and allowing mixing of the material within the canister by use of a rotary tool. A housing has a main axis having a guide to position the center axis of the canister coincident with the main axis of the housing and for removably holding the canister of material for movement both longitudinally along and rotation about the main axis. The housing includes a first end portion and an opposite second end portion. A stem has a stem axis of rotation and is rotatably mounted to the housing being located at the first end portion. The stem has a stem end to drivingly receive a rotary drill for rotation of the stem about the stem axis of rotation. A spherical ball is mounted on the stem and has a center with the ball located at the first end portion and offset relative to the main axis to engage the canister and rotate the canister about the main axis. The center of the ball is positioned offset relative to the stem axis of rotation so the ball engages the canister and moves the canister along the main axis. A spring is mounted to the housing and is operable to urge the canister into engagement with the ball but yieldable to allow the canister to be disengaged from the ball and removed from the housing.

Another embodiment of the present invention is a device for agitating a canister of material having a longitudinally extending center axis and allowing mixing of the material within the canister by use of a rotary tool. A housing has a main axis and has a guide to position the center axis of the canister of material along the main axis of the housing and for removably holding the canister of material for movement along the main axis. The housing includes a first end portion and an opposite second end portion. A stem has a stem axis of rotation and is rotatably mounted to the housing and located at the first end portion. The stem has a stem end to drivingly receive a rotary drill for rotation of the stem about the stem axis of rotation. A ball mounted on the stem is located at the first end portion and is offset relative to the stem axis of rotation to engage the canister and move the canister along the main axis. A spring is mounted to the housing and is operable to urge the canister into engagement with the ball but yieldable to allow the canister to be disengaged from the ball and removed from the housing.

It is an object of the present invention to provide a lightweight holder for removably holding a canister of material in such a manner that the material may be thoroughly mixed within the canister by means of a rotary tool.

A further object of the present invention is to provide a device for agitating a canister of material both by reciprocally moving the canister as well as rotating the canister.

Yet another object of the present invention is to provide a new and improved device for reciprocally moving a canister of material in such a manner that the material therein is thoroughly mixed.

An additional object of the present invention is to provide a new and improved device for agitating a canister of material by rotating the canister.

Related objects and advantages of the present invention will be apparent from the following description.

DESCRIPTION OF THE PREFERRED EMBODIMENT

Figure 1:
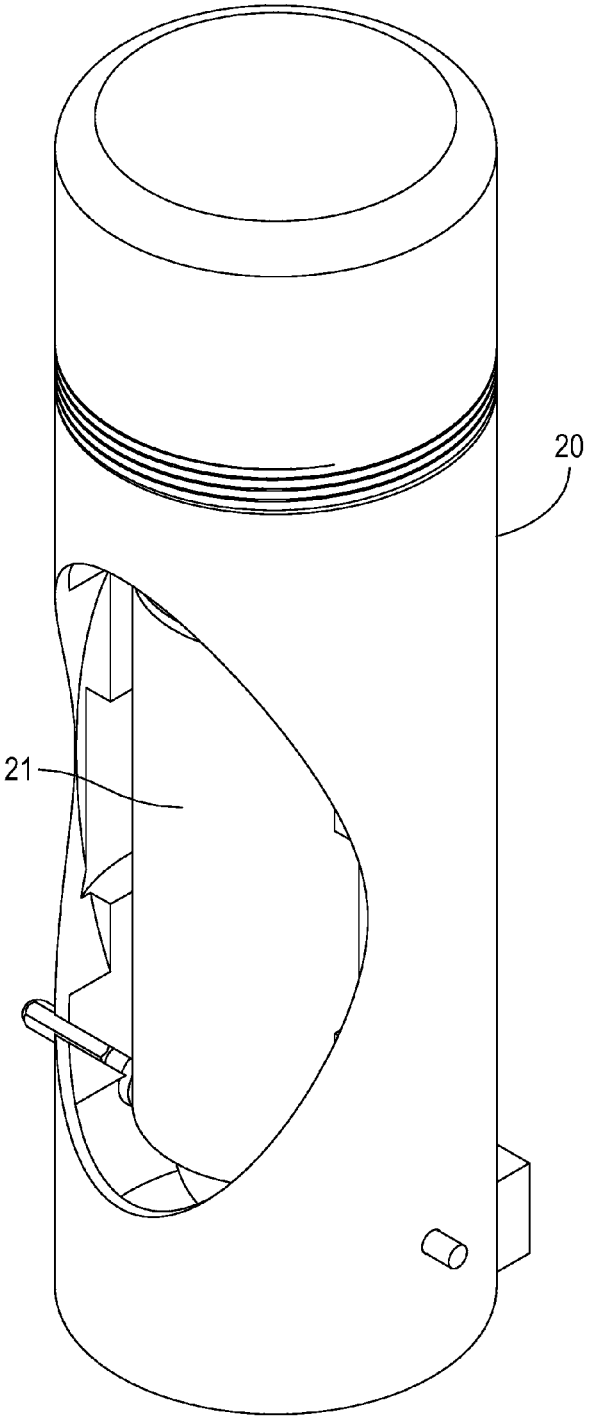
FIG. 1 is a perspective view of the device incorporating the present invention holding a aerosol canister of material.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
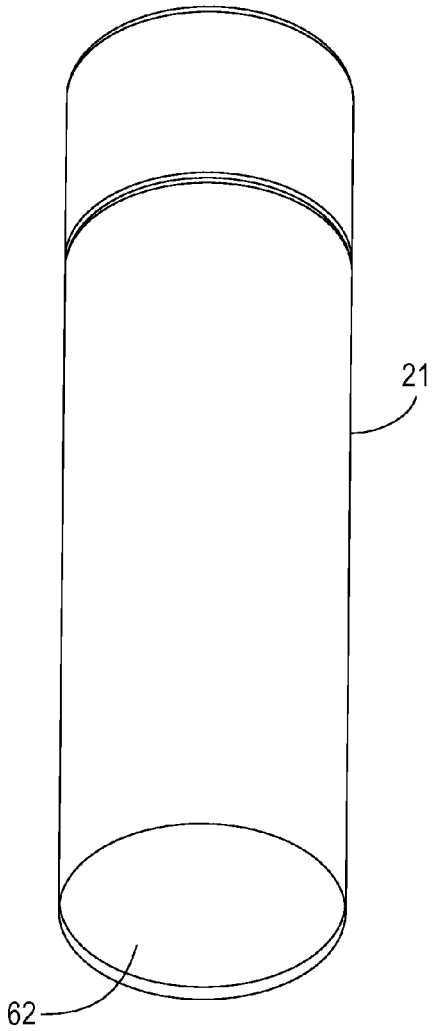
FIG. 2 is a perspective view of a typical aerosol canister holding material to be mixed.
Figure 3:
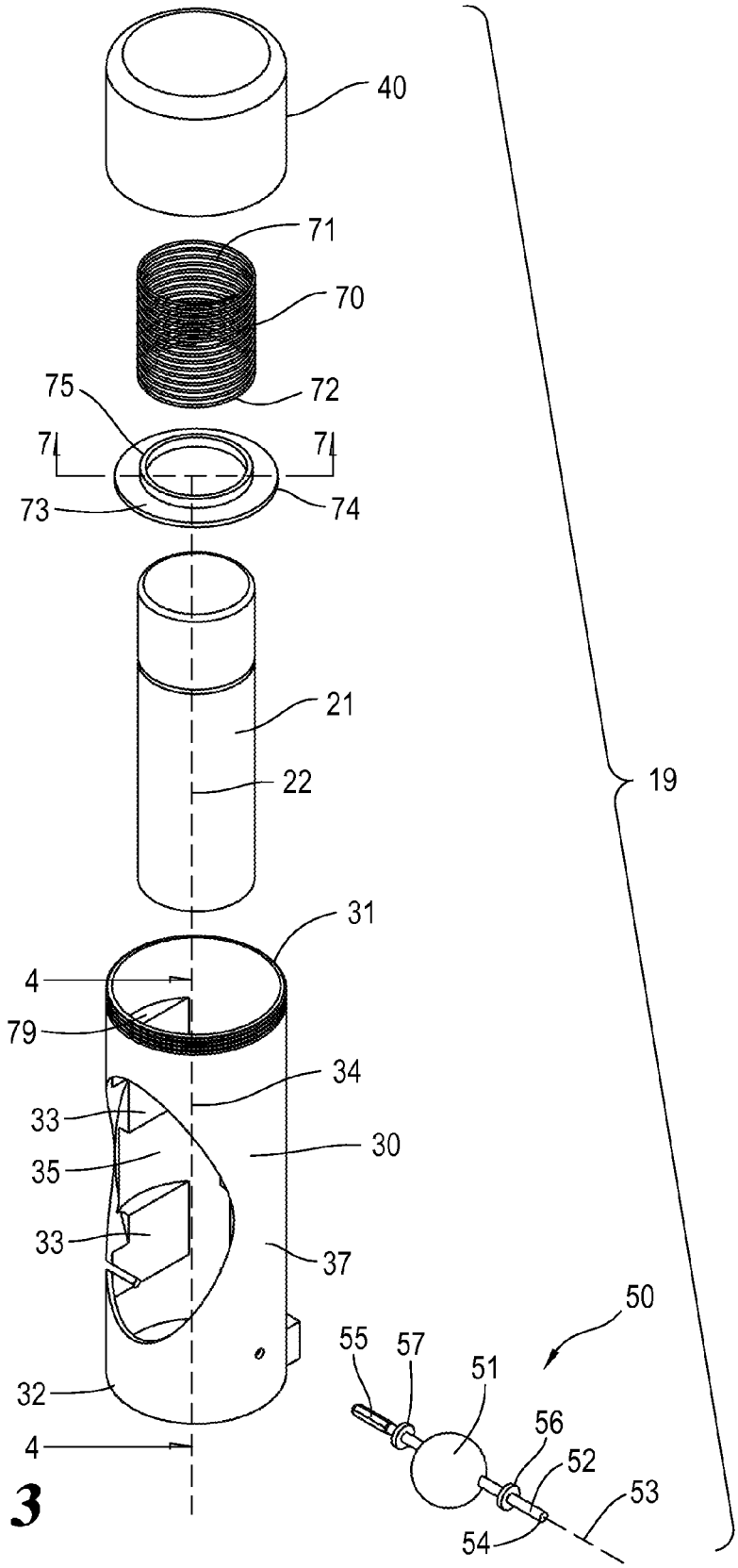
FIG. 3 is an exploded view of the combination 19 of the device and canister of FIG. 1.
Figure 8:
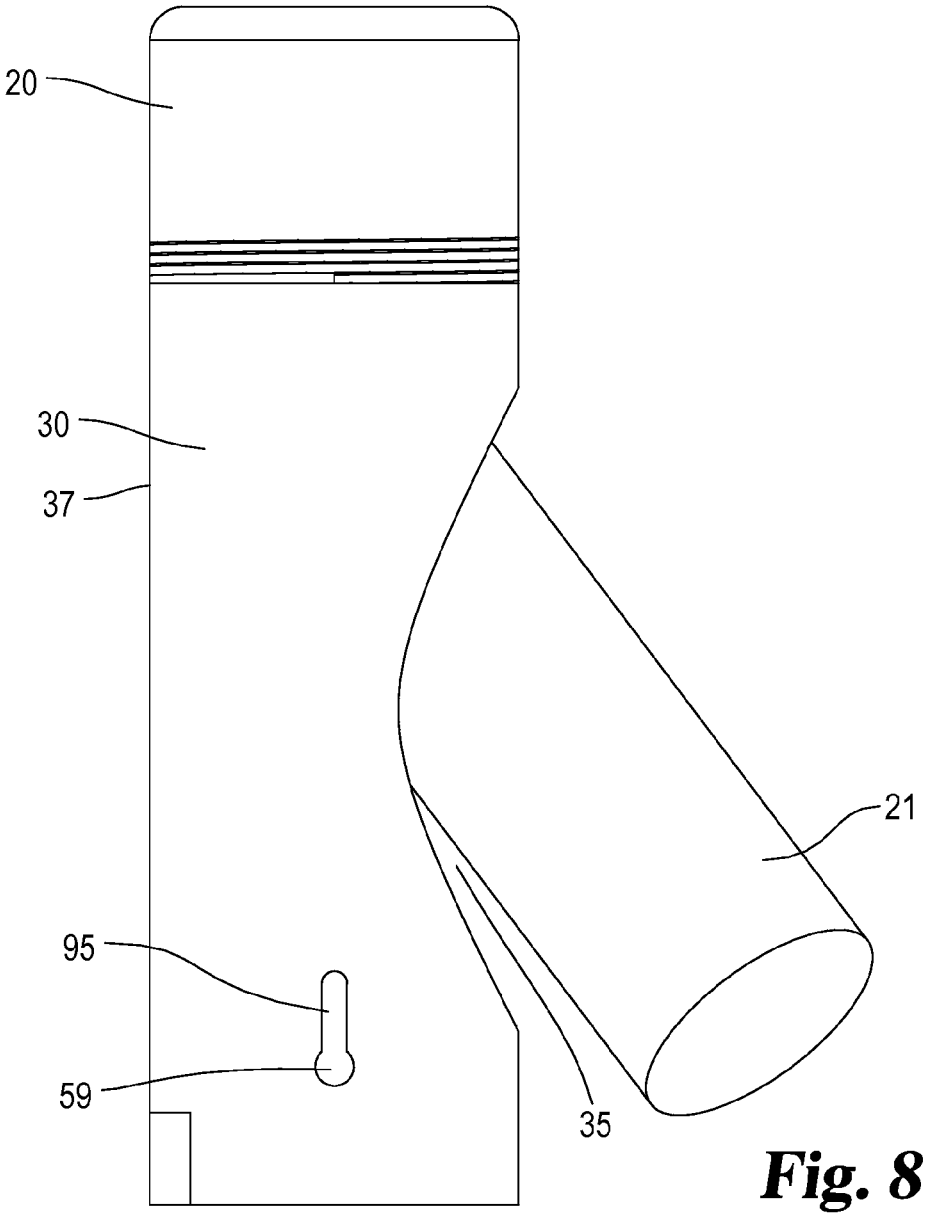
FIG. 8 is a perspective view of the canister being inserted into the device housing.

Referring to FIGS. 1-3, there is shown a spray can mixer 20 for removably receiving a canister 21 having material therein to be emitted by the canister. Mixer 20 has a cylindrical housing 30 with a top end portion 31 and a bottom end portion 32. Located between end portions 31 and 32 is an opening 35 (FIG. 8) through which canister 21 may be inserted and removed from the housing 30. Housing 30 has a longitudinally extending main axis 34 extending between the two end portions 31 and 32. The housing has a bottom wall 36 (FIG. 4) extending there across being joined to the cylindrical side wall 37. The top end portion 31 is open when in the unassembled state but is closed when cap 40 is attached thereto. Spacers 33 are integrally formed with side wall 37 and extend around the interior circumference of the housing with the exception at opening 35. Spacers 33 have inwardly facing surfaces that act as a guide or provide stop surfaces for holding and limiting excessive side motion of canister 21 along axis 34. Spacers 33 may be integral with the housing side wall or may be separate therefrom and fixedly attached interiorly to the side wall. In addition, a concave spacer 99 (FIG. 4) is provided within housing 30 on the side wall 37 opposite of opening 35 (FIG. 8). Spacer 99 may be integrally formed with side wall 37 and guides the canister 21 when inserted or removed via opening 35 while insuring the canister is properly located relative to spacers 33 and ball 51.

Canister 21 has a longitudinally extending center axis 22. When the canister 21 is inserted into housing 30 via opening 35, the canister axis 22 is coincident, parallel and the same as axis 34 since spacers 33 engage or guide the canister.

A driver 50 has a spherical ball 51 integrally mounted to axle or stem 52 rotatably mounted to housing 30 at the bottom end portion 32 of the housing. Axle 52 has opposite end portions 54 and 55 which respectively extend through holes 59 and 58 (FIG. 4) of housing side wall 37. A pair of washers or discs 56 and 57 (FIG. 3) are integrally mounted to axle 52 and located within the housing immediately adjacent respectively the side wall holes 58 and 59. Spherical ball 51 is therefore held in place preventing sideways motion within housing 30 along the axis of axle rotation 53. Axle 52, ball 51 and discs 56 & 57 may be produced as a one piece plastic component of the mixer.

The bottom wall 62 (FIG. 2) of canister 21 has a concave surface 81 (FIG. 6) as viewed from the bottom exterior of the canister and is engaged by the outwardly facing surface of ball 51. Spacers 33 limit sideways motion of the canister within housing 30 with ball 51 being positioned to the side of the longitudinal center axis 22 of the canister and housing main axis 34 thereby causing rotation of the canister within the housing. Axes 22 and 34 are parallel and extend along the same line, and are perpendicularly arranged relative to the axle rotation axis 53.

Figure 5:
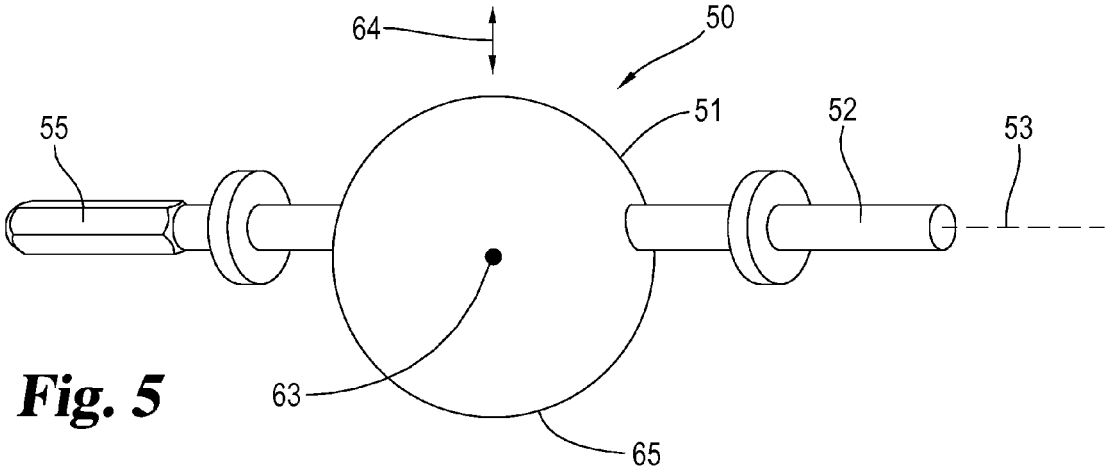
FIG. 5 is an enlarged view of the driving mechanism for imparting motion to the canister of FIG. 2.

An enlarged view of driver 50 is shown in FIG. 5. Ball 51 has a center 63 that is offset relative to the axis of rotation 53 of axle 52. In other words, axle 52 extends fixedly through ball 51 to the side of center 63 and does not intersect the ball center. Thus, when axle 52 is rotated about axis 53, the outside surface 65 of the ball advances and withdrawals in the direction of arrow 64 (FIG. 5) along an axis perpendicular to axis 53 imparting reciprocal motion of the canister along housing main axis 34 and the canister longitudinal center axis 22. End 55 of axle 52 is located outwardly of housing 30 and is configured to mate with a rotary power drill. In the embodiment shown in FIG. 5, end portion 55 is provided with a hexagonal cross-section to matingly receive the rotary output of a rotary drill. The rotary drill is releasably engageable with end portion 55 to cause rotation of axle 52 and ball 51 around the axis of rotation 53.

Figure 7:
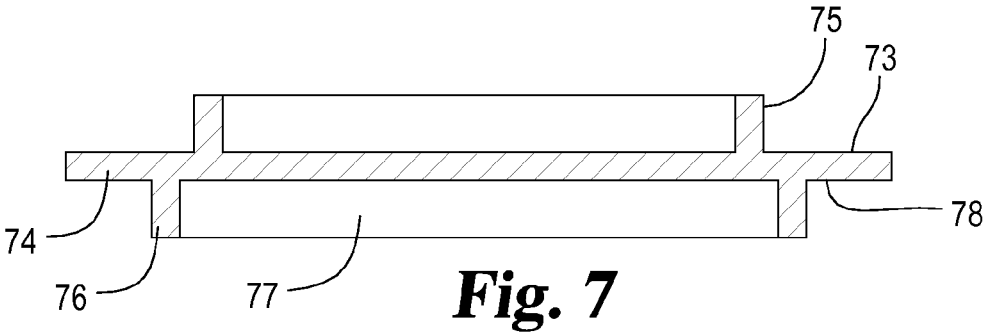
FIG. 7 is an enlarged cross-sectional view taken along the line 7-7 of FIG. 3 and viewed in the direction of the arrows.

A helical spring 70 (FIG. 3) has a top end 71 nesting within cap 40 and a bottom end 72 resting atop the top surface 73 of slide 74. A cylindrical ridge 75 (FIG. 7) projects upwardly from surface 73 and extends inwardly of the spring coil allowing for the secure mounting of the spring to the slide. Slide 74 has a second cylindrical ridge 76 (FIG. 7) projecting downwardly therefrom defining an interior cavity 77 to nestingly receive the top of canister 21. Projections may be provided extending inwardly from side wall 37 of housing 30 to contact the downwardly facing surface 78 of slide 74 to limit the downward movement of the slide. For example, guide 33 has an upwardly facing surface 79 (FIG. 3) that may be used for contacting surface 78 (FIG. 7) of the slide.

Figure 4:
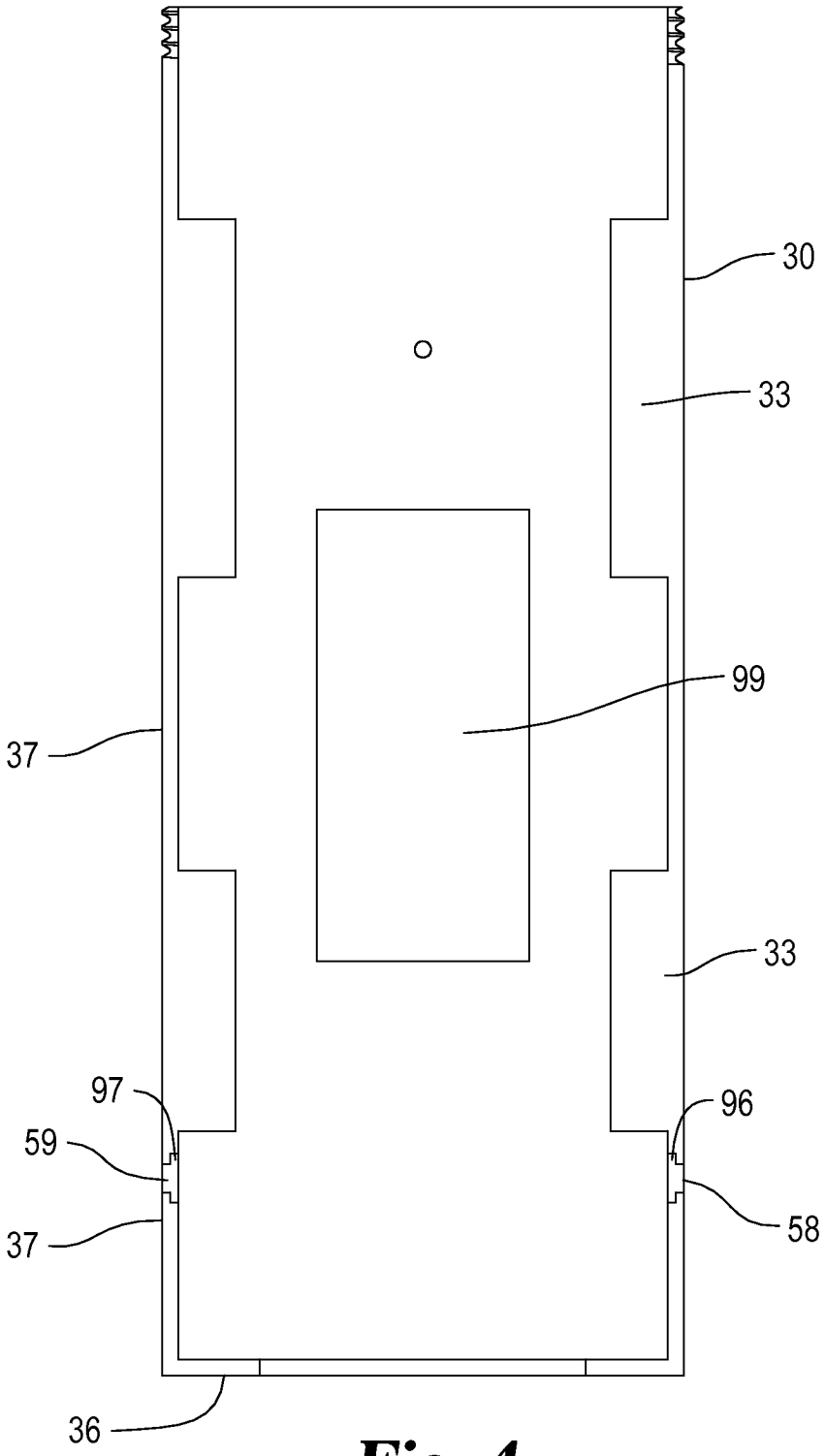
FIG. 4 is an enlarged cross-sectional view taken along the line 4-4 of FIG. 3 and viewed in the direction of the arrows.

Cap 40 is mounted to the top end portion of the housing and forms cooperatively therewith an enclosure in which slide 74 is movably mounted. The cap may be screwed onto external threads provided at the top end 31 of the housing or other variations in the connection are possible. For example, the cap may be secured to the housing by adhesive or other materials. Prior to mounting cap onto housing 30, spring 70 is extended into the cap with the opposite end resting upon slide 74. Slide 74 along with the spring is then inserted into the housing with the cap then being permanently secured. To install driver 50 to housing 30, the end portion 54 (FIG. 3) of axle 52 is extended into opening 35 and through opening 58 until ball 51 and the axle opposite end portion 55 (FIG. 2) are located within the housing. The axle should then be moved longitudinally while extending the opposite end portion 55 through slot 95 (FIG. 8) with the axle then being forced down through the slot until the axle is located in hole 59 provided in the housing side wall. Slot 95 has a width less than the diameter of hole 59 thereby insuring the axle does not disengage the hole. The center 63 (FIG. 6) of the ball is located to the side of housing main axis 34 so that the outer surface 65 of the ball will contact the canister concave surface 81 to the side of the center or deepest portion 80 of surface 62. Holes 58 and 59 provided in the housing side wall 37 have respectively mutually facing recesses 96 and 97 into which the discs 56 and 57 seat automatically positioning ball 51 relative to side wall 37 and axis 34 (FIG. 4). The mixing device disclosed in the drawings and detailed herein when connected to a rotary tool will not only rotate the canister 20 about main axis 34 but also cause reciprocal motion of the canister along the housing main axis 34. Since housing main axis 34 and canister axis 22 are one and the same, then the rotation of the canister as well as the reciprocal motion of the canister occurs around and along axis 22.

Figure 6:
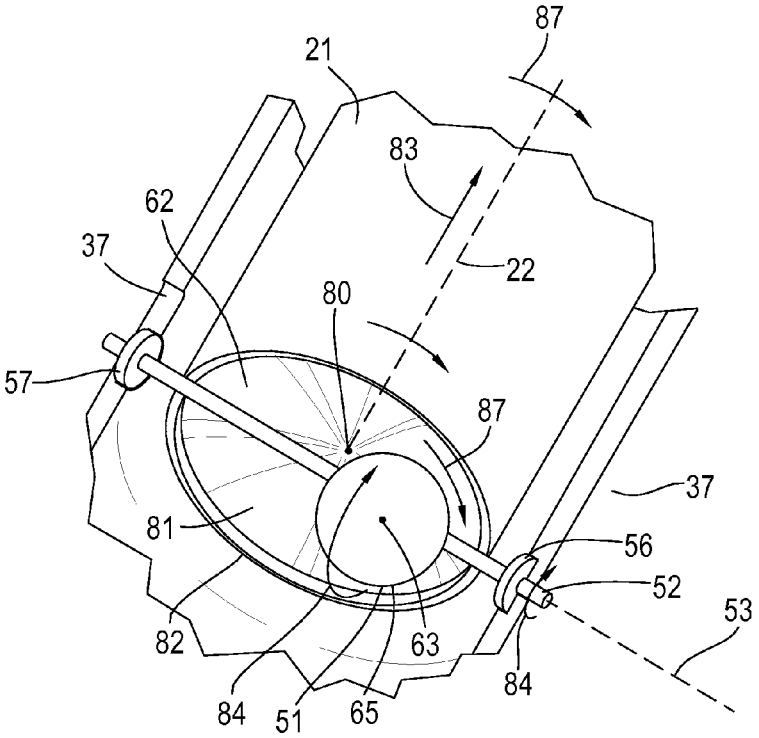
FIG. 6 is a fragmentary enlarged perspective view showing the driving ball causing reciprocal motion as well as rotary motion to the canister of material.

Referring to FIG. 6, a portion of the bottom end of canister 21 is depicted with the center longitudinal axis 22 extending the length of the canister and through the center 80 of the concave canister bottom wall 62. The concave surface 81 of wall 62 extends from the outer circumferential edge 82 of the can toward the deepest portion of the surface 81 located at the center 80 of concave wall 62. Axis 22 extends through center 80. Canister 21 is depicted in FIG. 6 as located within the cylindrical side wall 37 of the housing which is omitted from the drawings for purposes of clarity.

With axle or stem 52 rotating in the direction of arrow 84, ball 51 is also caused to rotate in the same direction as arrow 84. Spring 70 is operable to maintain contact at all times between the ball outer surface 65 and the canister concave surface 81. With axle 52 rotating, that portion of the outer surface 65 of the ball in contact with surface 81 reciprocates and moves in a direction of arrow 83 extending along axis 22. That is, that portion of ball surface 65 that is in contact with the concave surface 81 moves first in the direction of arrow 83 as the axis rotates and then in a reverse direction of arrow 83 causing canister 21 to likewise move in the direction of arrow 83 and then in a direction opposite of arrow 83. The canister is therefore moved back and forth in a direction parallel to axis 22. Simultaneously, rotation of ball 51 in the direction of arrow 84 causes the container to rotate about axis 22 in the direction of arrow 87 due to the center 63 of the ball being located or positioned offset relative to canister axis 22.

Once the desired amount of rotational movement and reciprocal movement is accomplished by rotating the axle with a rotary power drill, canister 21 may be removed from the mixer by moving the canister in the direction of the mixer cap thereby moving slide 74 compressing spring 70 with the bottom end of the canister then pulled outwardly through opening 35. Likewise, insertion of the canister into the mixer is achieved by inserting the top end of the canister into opening 35 contacting slide 74 and depressing spring 70 until the bottom end of the canister can then be also moved through aperture 35 resting the concave bottom wall of the canister atop ball 51.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for agitating a canister of material having a bottom wall with a concave surface and a longitudinally extending center axis extending therethrough and allowing mixing of the material within the canister by use of a rotary tool comprising:

a housing having a main axis extending in a first direction and having a guide to position said center axis of the canister coincident with said main axis of said housing and for removably holding the canister of material for movement both longitudinally in said first direction and rotation about said main axis, said housing including a first end portion and an opposite second end portion;

a stem having a stem axis of rotation and being rotatably mounted to said housing and located at said first end portion, said stem having a stem end to drivingly receive a rotary drill for rotation of said stem about said stem axis of rotation;

a spherical ball in contact with said concave surface of said canister, said spherical ball mounted on said stem and having a center with said spherical ball located at said first end portion and offset relative to said main axis so the spherical ball engages said concave surface of said canister, said center of said spherical ball positioned offset relative to said stem axis of rotation to engage said canister and reciprocally move said canister along said main axis in said first direction while simultaneously rotating said canister around said main axis; and, a spring mounted to said housing operable to urge said canister into engagement with said spherical ball but yieldable to allow said canister to be disengaged from said spherical ball and removed from the housing.

2. The device of claim 1 wherein:

said stem axis of rotation is perpendicularly arranged relative to said main axis of said housing.

3. The device of claim 2 and further comprising:

a cap mounted to said second end portion of said housing and forming cooperatively therewith an enclosure;

a slide movably mounted to said housing within said enclosure at said second end portion, said slide has a first surface against which said spring rests and an opposite facing second surface against which said canister is contactable, said spring operable to move said slide against said canister moving said canister into contact with said spherical ball but yieldable to allow said slide to move away from said spherical ball allowing said canister to be inserted or removed into said housing.

4. The device of claim 3 wherein said housing has a cylindrical side wall surrounding said canister with an opening extending through said side wall through which said canister may be inserted or removed from said housing.

5. A device for agitating a canister of material having a longitudinally extending center axis and allowing mixing of the material within the canister by use of a rotary tool wherein:

said canister of material having a bottom with a concave surface; and comprising:

a housing having a main axis and having a guide to position a center axis of the canister of material along said main axis of said housing and for removably holding the canister of material for movement along said main axis, said housing including a first end portion and an opposite second end portion;

a stem having a stem axis of rotation and being rotatably mounted to said housing and located at said first end portion, said stem having a stem end to drivingly receive a rotary drill for rotation of said stem about said stem axis of rotation;

a ball mounted on said stem to contact said concave surface and located at said first end portion being offset relative to said stem axis of rotation to engage said canister and reciprocally move said canister in a direction along said main axis while simultaneously rotating said canister about said main axis; and, a spring mounted to said housing operable to urge said canister into engagement with said ball but yieldable to allow said canister to be disengaged from said ball and removed from the housing.

6. The device of claim 5 and further comprising:

a cap mounted to said second end portion of said housing and forming cooperatively therewith an enclosure;

a slide movably mounted to said housing within said enclosure at said second end portion, said slide has a first surface against which said spring rests and an opposite facing second surface against which said canister is contactable, said spring operable to move said slide against said canister moving said canister into contact with said ball but yieldable to allow said slide to move away from said ball allowing said canister to be inserted or removed into said housing.

7. The device of claim 6 and further comprising:

washers on said stem to contact said housing to limit movement of said stem in the direction of said stem axis of rotation.

8. A device for agitating a canister of material having concave bottom wall and a longitudinally extending center axis and allowing mixing of the material within the canister by use of a rotary tool wherein:

the canister of material having a bottom wall with a concave surface and a center axis extending therethrough; and comprising:

a housing having a main axis and having a guide to position a center axis of the canister along said main axis of said housing and for removably holding the canister of material, said housing including a first end portion and an opposite second end portion;

a stem having a stem axis of rotation and being rotatably mounted to said housing and located at said first end portion, said stem having a stem end to drivingly receive a rotary tool for rotation of said stem about said stem axis of rotation;

a ball in contact with said concave surface of said canister and mounted on said stem and having a center with said ball located at said first end portion and offset relative to said main axis to engage said concave bottom wall of the canister offset from said main axis and rotate said canister about said main axis, said stem extends through said ball off center moving said canister in a reciprocal motion in a direction of said main axis; and, a spring mounted to said housing operable to urge said canister into engagement with said ball but yieldable to allow said canister to be disengaged from said ball and removed from the housing.

9. The device of claim 8 and further comprising:

a cap mounted to said second end portion of said housing; and, a slide slidably mounted within said cap, said spring has a first spring end abutting said cap and an opposite second spring end abutting said slide, said spring operable to move said slide to engage said canister and move said canister against said ball, said slide has a recess into which said canister projects.

10. The device of claim 9 and further comprising:

discs on said stem contacting said housing to limit movement of said ball on said stem in the direction of said stem axis.

* * * * *